US007889169B2

(12) United States Patent
Inuzuka et al.

(10) Patent No.: US 7,889,169 B2
(45) Date of Patent: Feb. 15, 2011

(54) IMAGE DISPLAY DEVICE AND IMAGE DISPLAY METHOD

(75) Inventors: Tatsuki Inuzuka, Mito (JP); Tsunenori Yamamoto, Hitachi (JP); Akitoyo Konno, Hitachi (JP)

(73) Assignee: Hitachi Displays, Ltd., Chiba (JP)

( * ) Notice: Subject to any disclaimer, the term of this patent is extended or adjusted under 35 U.S.C. 154(b) by 835 days.

(21) Appl. No.: 11/434,901

(22) Filed: May 17, 2006

(65) Prior Publication Data

US 2006/0262078 A1 Nov. 23, 2006

(30) Foreign Application Priority Data

May 19, 2005 (JP) ..... 2005-146306

(51) Int. Cl.
*G09G 3/36* (2006.01)
*G09G 5/00* (2006.01)

(52) U.S. Cl. ..... 345/102; 345/690; 345/204; 345/87

(58) Field of Classification Search ..... 345/102, 345/690, 691, 88, 87, 204
See application file for complete search history.

(56) References Cited

U.S. PATENT DOCUMENTS 4,870,484 A 9/1989 Sonehara
6,271,825 B1 * 8/2001 Greene et al. ..... 345/694
6,704,008 B2 * 3/2004 Naito et al. ..... 345/207
7,050,074 B1 * 5/2006 Koyama ..... 345/690
7,525,528 B2 * 4/2009 Feng ..... 345/87

FOREIGN PATENT DOCUMENTS

JP 2001-134226 5/2001

* cited by examiner

*Primary Examiner*—Duc Q Dinh
(74) *Attorney, Agent, or Firm*—Antonelli, Terry, Stout & Kraus, LLP.

(57) ABSTRACT

The present invention provides an image display device that forms an image with a display output that is a combination of quantities of backlight of at least three colors and sub-pixel transmittances of at least three colors, comprising:

a memory means in which the light-emission wavelength distribution characteristics of the quantities of backlight and the transmission wavelength distribution characteristics of the sub-pixel transmittances are stored, wherein:

the light-emission wavelength distribution characteristics and transmission wavelength distribution characteristics are read out from the memory means, and the sub-pixel transmittances based on the quantities of backlight are obtained.

13 Claims, 5 Drawing Sheets

IMAGE DISPLAY DEVICE AND IMAGE DISPLAY METHOD

CLAIM OF PRIORITY

The present application claims priority from Japanese application serial No. 2005-146306, filed on May 19, 2005, the content of which is hereby incorporated by reference into this application.

FIELD OF THE INVENTION

The present invention relates to an image display device such as a liquid crystal display device and an image display method that display a color image.

BACKGROUND OF THE INVENTION

One type of color image display device is a liquid crystal display that displays an image using in combination a backlight and a liquid crystal panel which controls the transmittance of a liquid crystal at each pixel location (hereinafter, pixel). For display of a color image, the backlight includes at least three color light sources of red, green, and blue, and each of pixels in the liquid crystal panel includes sub-pixels at which three color filters of red, green, and blue are disposed. The transmittances of a liquid crystal at respective sub-pixels with red, green, and blue color filters are controlled in order to control the quantities of backlight emitted from the red, green, and blue light sources, whereby an image is displayed.

The sub-pixel signifies the smallest unit pixel location at which any of red, green, and blue color filters is disposed. Three sub-pixels at which three color filters of red, green, and blue respectively are disposed are combined in order to construct a pixel. A plurality of pixels are disposed in order to construct a screen.

The principles of display will be briefed below. The quantities of backlight emitted from three color light sources are adjusted based on the transmittances of a liquid crystal at respective sub-pixels, whereby shades to be displayed at respective sub-pixel can be controlled. Color filters are disposed at respective sub-pixel so that the shades of red, green, and blue can be displayed. The display output is calculated as a product of the quantities of backlight by the transmittances of the liquid crystal. Herein, a gamma that is not proportional to or independent of a wavelength. Herein, however, data is proportional to or dependent on a wavelength.

Assuming that a fluorescent lamp is adopted as a backlight and lit all the time, since a quantity of backlight remains constant, variables to be employed in the above multiplication are the transmittances of the liquid crystal at respective sub-pixels.

Patent Document 1 describes a constituent feature of improving a contrast by controlling a quantity of backlight. In this case, a display output represents the result of a multiplication employing as variables the quantity of backlight and the transmittance of the liquid crystal panel. Herein, the maximum and minimum values of a display signal are referenced as factors with which the quantity of backlight is controlled.

Moreover, Patent Document 2 describes that the wavelength regions of light waves emitted from a backlight and the passbands of color filters at respective sub-pixels are taken into consideration. Herein, the wavelength regions of light waves emitted from the backlight are made narrower than the passbands of the color filters, whereby a color domain is expanded. The backlight comprises light-emitting diodes (LED).

[Patent Document 1] Japanese Patent No. 3430998

[Patent Document 2] Japanese Unexamined Patent Publication No. 60-130715

In the background art, image quality is improved by devising a backlight. However, the background art is not intended to reduce energy (power consumption) required for driving the backlight.

Patent Document 1 introduces a constituent feature of varying a quantity of backlight. However, an object is to improve the contrast of a display screen but no consideration is taken into a power consumption. Moreover, Patent Document 2 describes a constituent feature of improving image quality using a backlight comprising LEDs. However, no consideration is taken into the power consumption. Both Patent Document 1 and Patent Document 2 do not take account of reducing energy (power consumption) to be consumed by the backlight.

In the course of solving the foregoing problems, a phenomenon of a leakage (crosstalk) of red, green, or blue poses as an obstacle to be overcome. Assuming that the wavelength regions of light waves emitted from LEDs included in a backlight are inconsistent with the passbands of color filters incorporated in a liquid crystal panel, the aforesaid multiplication cannot be achieved relative to each of red, green, and blue. Consequently, two of red, green, and blue correlate with each other. This brings about the crosstalk.

Patent Document 1 makes it a precondition to adopt a fluorescent lamp as a white light source but does not take account of the wavelength region of emitted light. Moreover, Patent Document 2 describes that LEDs are adopted as white light sources whose light waves exhibit peaks at wavelengths representing respective primary colors of red, green, and blue, but does not take account of the variation of the wavelength regions of light waves emitted from the LEDs. The second object of the present invention is to cope with a newly arisen problem of a crosstalk.

SUMMARY OF THE INVENTION

The present invention relates to a display device that uses a backlight comprising light-emitting diodes (LEDs). The first object of the present invention is to reduce energy (power consumption) while maintaining satisfactory image quality.

The present invention provides an image display device that forms an image with a display output that is a combination of quantities of backlight of at least three colors and sub-pixel transmittances of at least three colors, comprising:

a memory means in which the light-emission wavelength distribution characteristics of the quantities of backlight and the transmission wavelength distribution characteristics of the sub-pixel transmittances are stored, wherein:

the light-emission wavelength distribution characteristics and transmission wavelength distribution characteristics are read out from the memory means, and the sub-pixel transmittances based on the quantities of backlight are obtained.

DESCRIPTION OF THE PREFERRED EMBODIMENTS

Figure 1:
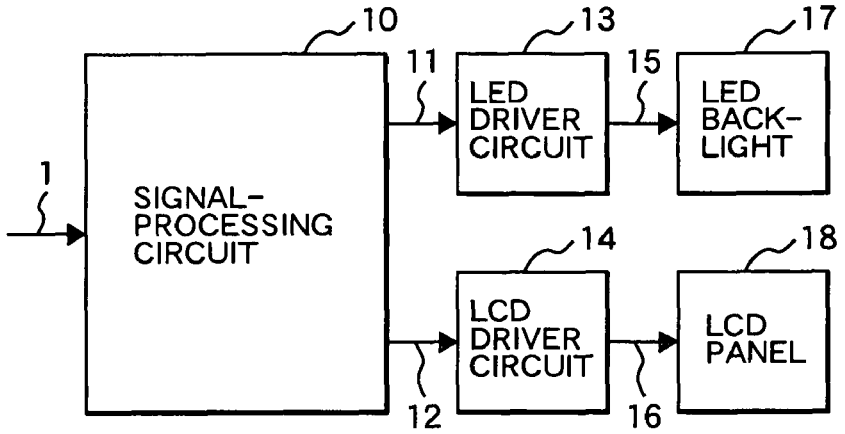
FIG. 1 shows the configuration of an image display device in accordance with the present invention.

In efforts to achieve the first object, one aspect of the present invention includes a means for driving red, green, and blue LEDs included in a backlight, which is adopted as a white light source, on the basis of minimum quantities of backlight necessary for calculating a display output, and thus reduces a power consumption.

In efforts to achieve the second object in relation to the first object, another aspect of the present invention includes a memory means for preserving data concerning the wavelength regions of light waves emitted from a backlight, which is included in a display device, and the passbands of color filters, that is, the wavelength regions relevant to the quantities of backlight and the wavelength regions relevant to the transmittances at respective sub-pixels. The transmittances of a liquid crystal at respective sub-pixels are corrected based on the quantities of backlight.

Moreover, a memory means is included for preserving crosstalk coefficients based on the quantities of backlight emitted from red, green, and blue LEDs. Also included is a means for correcting the transmittances at respective sub-pixels according to the coefficients. The quantities of backlight and the transmittances at respective sub-pixels corrected based on the quantities of backlight are converted into a driving signal. Thus, a display output is produced.

The present invention is adapted to a display device that adopts a backlight comprising light-emitting diodes (LED) and controls both the quantities of backlight emitted from the LEDs and the transmittances of a liquid crystal panel, and will prove advantageous because both sustenance of satisfactory image quality and reduction of energy (power consumption) can be achieved.

Referring to the drawings, embodiments of the present invention will be described below.

First Embodiment

FIG. 1 shows the basic configuration of an image display device in accordance with the present invention. A signal processing circuit 10 separates an input signal 1 into quantities 11 of backlight emitted from red, green, and blue LEDs, and transmittances 12 of a liquid crystal at respective sub-pixels with red, green, and blue color filters respectively which are multiplied each other. An LED drive circuit 13 converts the quantities 11 of backlight emitted from red, green, and blue LEDs into an LED driving signal 15. A backlight 17 including the LEDs is driven based on the LED driving signal 15.

On the other hand, an LCD drive circuit 14 converts the transmittances 12 at respective sub-pixels with red, green, and blue color filters respectively into an LCD driving signal 16. An LCD panel 18 is driven based on the LCD driving signal. Finally, the backlight 7 and LCD panel 18 are driven. Eventually, a display image is produced. Each of the LED drive circuit and LCD drive circuit includes drive circuits associated with red, green, and blue respectively, and the drive circuits associated with red, green, and blue respectively are acted independently of one another. Moreover, the transmittances 12 at respective sub-pixels with red, green, and blue color filters respectively are controlled independently of one another in the same manner as they are in the conventional display device. The liquid crystal and each of the color filters at respective sub-pixels are used in combination, and the combination acts as a switch for selecting a wavelength region.

The present invention is characterized in that the red, green, and blue LEDs included in the backlight 17 are controlled independently of one another. This is a fundamental difference from a related art in which: a backlight is a white light source realized with a fluorescent lamp or an LED that is used to display all colors; and light emanating from the backlight has an unchangeable wavelength region.

Figure 2:
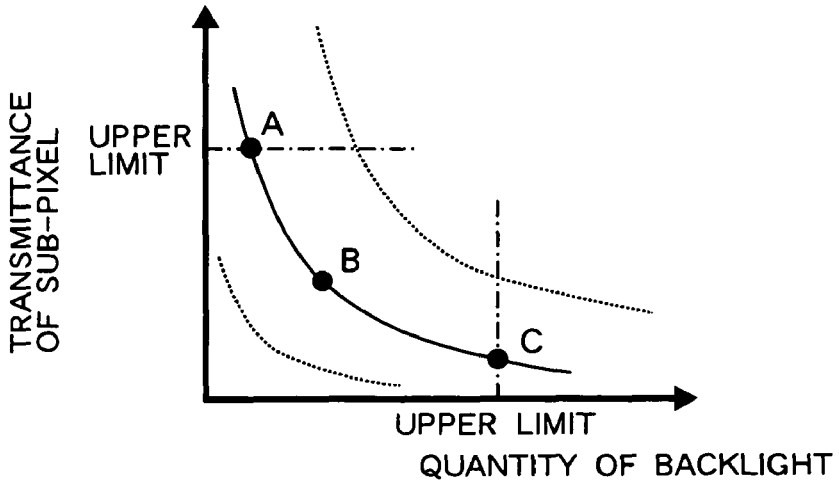
FIG. 2 shows the relationship between the quantities of backlight and the transmittances of a liquid crystal at respective sub-pixels that are multiplied each other.

FIG. 2 is an explanatory diagram concerning the quantities of backlight emitted from red, green, or blue LEDs respectively and the transmittances at respective sub-pixels with red, green, and blue color filters respectively which are multiplied each other. A display output is a product of the quantities of backlight emitted from red, green, or blue LEDs respectively by the transmittances at respective sub-pixels with red, green, and blue color filters respectively.

FIG. 2 demonstrates that the quantities of backlight and the transmittances at respective sub-pixels are inversely proportional to each other for a constant display output. Herein, no consideration is taken into a gamma that is not proportional to or independent of a wavelength. Assuming that the gamma is employed, the gamma is multiplied by an inverse number of the gamma so that the quantities of backlight and the transmittances at respective sub-pixels will have the above relationship.

In FIG. 2, as long as point A, B, or C represents acceptable values, the result of multiplication of the above two kinds of variables, that is, a display output remains constant. In other words, the quantities of backlight emitted from red, green, and blue LEDs respectively and the transmittances at respective sub-pixels with red, green, and blue color filters respectively can be determined with freedom.

Point A represents acceptable values and indicates quantities of backlight permitting maximum transmittances. A display output is obtained by minimizing decreases in the quantities of light stemming from the transmittances at respective sub-pixels and maximizing the quantities of backlight. The present invention focuses the point A in efforts to minimize the power consumption required by the backlight.

If a screen includes a sole pixel, the above condition should merely be applied to the pixel. However, an actual screen includes numerous pixels. Now, the structure of the screen will be described below.

Figure 3A:
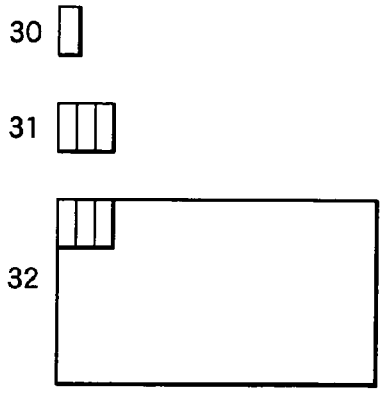
FIGS. 3A and 3B include explanatory diagrams showing a screen structure and the relationship between a display output and a frequency.

FIG. 3A shows the relationship between the screen structure and a pixel. A sub-pixel 30 is a minimum unit at which the transmittance of a liquid crystal can be controlled. Any of red, green, and blue color filters is allocated to the sub-pixel 30, so that a shade can be controlled and a wavelength region can be selected. Three sub-pixels with red, green, and blue color filters respectively are combined with one another in order to construct a pixel 31 that is the minimum unit at which a color can be reproduced. The pixels 31 are arranged on a planar basis in order to construct a screen 32.

A backlight that illuminates the screen 32 but is not shown is prepared in order to control the transmittances at the plurality of sub-pixels 30 within the screen. Consequently, a color image whose gray levels are changed smoothly is displayed over the screen.

In the present invention, the minimum quantities of backlight necessary for displaying pixel data on the screen with a maximum display output are adopted in order to minimize the power consumption for the backlight.

Figure 3B:
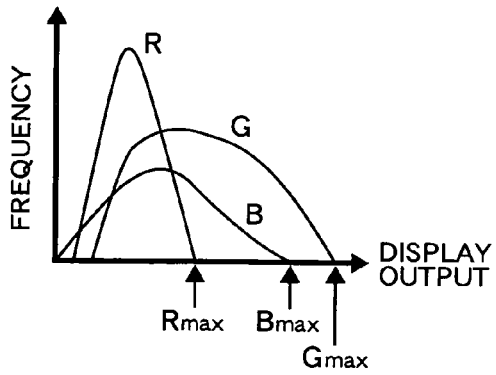

FIG. 3B shows an example of curves representing red, green, and blue color signals respectively. What are focused therein are maximum values Rmax, Gmax, and Bmax of the red, green, and blue color signals. The quantities of backlight for each screen image are determined based on the maximum values. The determined quantities of backlight are used to calculate the transmittances at respective sub-pixels with red, green, and blue color filters respectively which are multiplied by the quantities of backlight emitted from red, green, and blue LEDs. Thus, the quantities of backlight emitted from red, green, and blue LEDs respectively and the transmittances at sub-pixels with red, green, and blue color filters respectively can be calculated relative to all sets of sub-pixels in the screen.

Figures 4A, 4B, 4C:
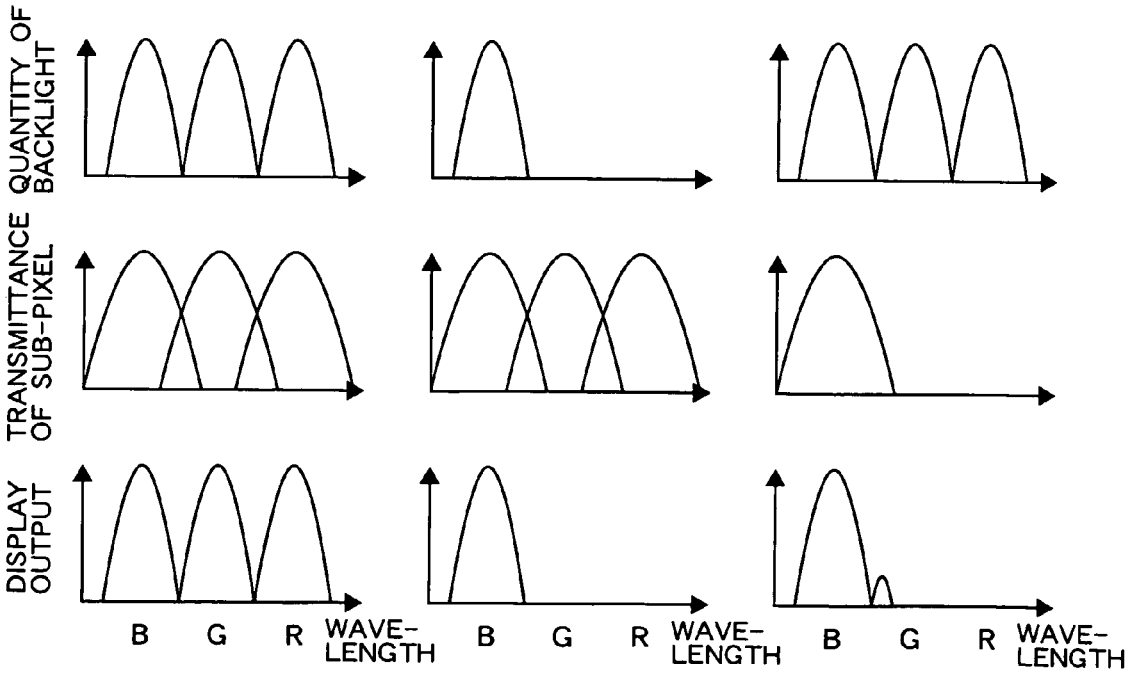
FIGS. 4A to 4C show characteristic curves indicating quantities of backlight emitted from red, green, and blue LEDs or the transmittances of a liquid crystal at respective sub-pixels with red, green, and blue color filters in relation to a wavelength.

FIGS. 4A to 4C show the relationship of the quantities of backlight, the transmittances at respective sub-pixels, or a display output to wavelengths. Herein, for brevity's sake, characteristic curves plotted to show the relationship to the wavelength regions of red, green, and blue respectively are convex curves. Herein, the wavelength regions relevant to the quantities of backlight are shown to be generally different from the wavelength regions relevant to the transmittances at respective sub-pixels.

The wavelength regions relevant to the quantities of backlight depend on the wavelength regions of light waves emitted from the three red, green, and blue LEDs, and driving signals to be applied to the respective LEDs. On the other hand, the wavelength regions relevant to the transmittances at respective sub-pixels depend on the passbands of the respective color filters. Since the two sets of characteristic curves are plotted in different methods, they are hardly matched with each other. How the difference between the characteristic curves affects a display output will be described below.

FIG. 4A shows display or production of white by maximizing the quantities of backlight and the transmittances at respective sub-pixels. Consequently, white is displayed or produced.

FIG. 4B shows display or production of blue. Only the quantity of backlight emitted from the blue LED is maximized, and the transmittances at respective sub-pixels with red, green, and blue color filters respectively are maximized. Consequently, the quantity of backlight emitted from the blue LED is represented by a display output.

FIG. 4C shows display or production of blue. The quantities of backlight emitted from the red, green, and blue LEDs are all maximized, and only the transmittance at a sub-pixel with a blue color filter is maximized. Herein, a display output represents a combination of the quantities of backlight emitted from red, green, and blue LEDs respectively and the transmittance at a sub-pixel with a blue color filter. The wavelength region relevant to the transmittance at a sub-pixel with a blur color filter is inconsistent with the wavelength region relevant to the quantity of backlight emitted from a blue LED, but overlaps the wavelength region relevant to the quantity of backlight emitted from a green LED. Consequently, the quantity of backlight emitted from a green LED is transmitted by the sub-pixel with a blue color filter, and is displayed or produced. This results in a color leakage (crosstalk) between two of red, green, and blue.

As mentioned above, the wavelength region of blue to be displayed varies depending on a selected display method. Likewise, even when red or green is displayed, the wavelength region of red or green changes due to a crosstalk.

Consequently, a crosstalk (color leakage) between two of red, green, and blue occurs under the conditions that (1) the red, green, and blue LEDs included in the backlight are controlled independently of one another, and (2) the wavelength regions of light waves emitted from the red, green, and blue LEDs included in the backlight are inconsistent with the passbands of the red, green, and blue color filters at respective sub-pixels.

The primary colors of red, green, and blue to be displayed on the display device should remain constant. However, the primary colors of red, green, and blue vary due to occurrence of a crosstalk. This is a factor of deteriorating image quality.

The present invention is characterized in that the primary colors are stabilized by compensating a crosstalk in order to guarantee satisfactory image quality.

Figure 5:
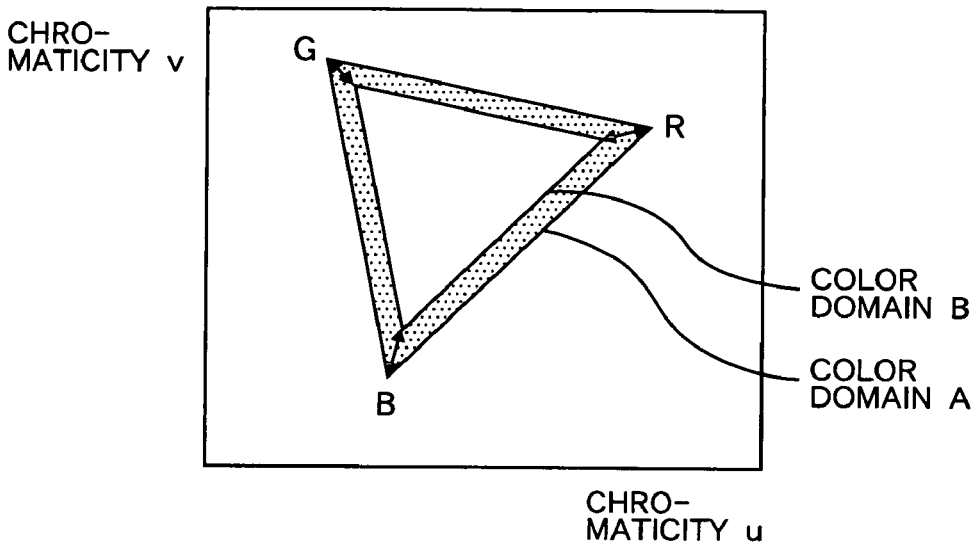
FIG. 5 is an explanatory diagram showing a change of color domains.

FIG. 5 shows a color domain that can be displayed and is defined by linking points that represent the chromaticity values of the primary colors of red, green, and blue. A domain A whose chromaticity values are plotted to lie on an outermost side causes the backlight including red, green, and blue LEDs to emit monochrome light. A domain B whose chromaticity values are plotted to lie on an innermost side causes the backlight including red, green, and blue LEDs to emit full color.

Assume that the quantities of light emitted from the red, green, and blue LEDs included in the backlight are determined based on the maximum values Rmax, Gmax, and Bmax of red, green, and blue color signals shown in FIGS. 3A and 3B. In this case, the combination of the red, green, and blue color signals varies depending on the contents of a screen image. The points of the chromaticity values R, G, and B of the primary colors vary between the maximum domain A and minimum domain B. A color produced by the combination of the primary colors of red, green, and blue changes accordingly. Consequently, a color cannot be reproduced stably.

Crosstalk compensation is intended to stabilize color reproduction by suppressing the variation of the chromaticity values. In the present invention, values within the minimum domain B are adopted as stable chromaticity values. A color domain that varies depending on the quantities of light emitted from the red, green, and blue LEDs included in a backlight is mapped into the stable color domain B, whereby the crosstalk compensation is achieved.

In the present invention, a basic procedure of signal processing is such that: crosstalk coefficients needed for crosstalk compensation are calculated from the quantities of light emitted from the red, green, and blue LEDs included in the backlight which are determined for each screen image; and the crosstalk coefficients are used to correct the transmittances at respective sub-pixels. Thus, mapping to the stable color domain is achieved.

Prior to a description of crosstalk compensation, the principles of occurrence of a crosstalk will be outlined using a formula. According to the formula 1, color matching functions are used to obtain values representing wavelength regions. The color matching functions are already known in the field of colorimetry, and are synonymous with spectral tristimulus values.

$$\begin{bmatrix} Xrout & Yrout & Zrout \\ Xgout & Ygout & Zgout \\ Xbout & Ybout & Zbout \end{bmatrix} = \begin{bmatrix} rlcd & 0 & 0 \\ 0 & glcd & 0 \\ 0 & 0 & blcd \end{bmatrix} \begin{bmatrix} Crr & Cgr & Cbr \\ Crb & Cgg & Cbg \\ Crb & Cgb & Cbb \end{bmatrix} \begin{bmatrix} rled & 0 & 0 \\ 0 & gled & 0 \\ 0 & 0 & bled \end{bmatrix} \begin{bmatrix} Xrin & Yrin & Zrin \\ Xgin & Ygin & Zgin \\ Xbin & Ybin & Zbin \end{bmatrix} \quad \text{[Formula 1]}$$

In the formula 1, three numerical values Xbin, Ybin, Zbin represent products of the wavelength region (bin) of a light wave emitted from the blue LED included in the backlight by three spectral tristimulus values (X, Y, Z). In shorts, three sets of values (Xrin, Yrin, Zrin), (Xgin, Ygin, Zgin), and (Xbin, Ybin, Zbin) are worked out using three wavelength regions (rin, gin, bin) of light waves emitted from the red, green, and blue LEDs included in the backlight.

When it says that the quantities of backlight emitted from the red, green, and blue LEDs respectively are controlled independently of one another, it means that the three sets of values are multiplied by coefficients (rled, gled, bled), that is, it is expressed as rled·(Xrin, Yrin, Zrin), gled·(Xgin, Ygin, Zgin), and bled·(Xbin, Ybin, Zbin).

The coefficients (rled, gled, bled) to be used to independently control the quantities of backlight emitted from the red, green, and blue LEDs respectively represent driving signals to be applied independently to the red, green, and blue LEDs respectively. Since the coefficients are independent of wavelengths, they can be provided as a diagonal matrix. When the light waves emitted from the red, green, and blue LEDs respectively are routed to the respective color filters disposed at sub-pixels, a crosstalk between two of red, green, and blue occurs.

The crosstalk value is determined by the combination of the wavelength regions of light waves emitted from the red, green, and blue LEDs included in the backlight and the passbands of the red, green, and blue color filters. Crosstalk coefficients Cnn (where n denotes r, g, or b) that are provided as a 3×3 matrix represent the relationship between the wavelength regions and passbands.

The results of the multiplications represent light waves to be routed to respective sub-pixels. Using the transmittances at respective sub-pixels (rlcd, glcd, blcd) as the multiplier, the display output expressed by the left side of the formula 1 (Xrout, Yout, Zrout) (Xgout, Ygout, Zgout) (Xbout, Ybout, Zbout) is worked out. The transmittances at respective sub-pixels (rlcd, glcd, blcd) are provided as a diagonal matrix because they are independent of wavelengths.

The variation of the primary colors caused by independently driving the red, green, and blue LEDs included in the backlight is expressed in the term by the right side of the term expressing the transmittances at respective sub-pixels (rlcd, glcd, blcd). In other words, the wavelengths of light waves emitted from the red, green, and blue LEDs included in the backlight are multiplied by the transmittances at respective sub-pixels (rlcd, glcd, blcd). For crosstalk compensation, the transmittances at respective sub-pixels (rlcd, glcd, blcd) are corrected based on the quantities of backlight.

First, a model that associates a crosstalk value with the quantities of backlight, which are factors, is used to express the phenomenon of a crosstalk. For example, (1) the wavelength regions of light waves emitted by the red, green, and blue LEDs included in the backlight and the passbands of the color filters disposed at respective sub-pixels, (2) the numerical values obtained by multiplying (1) by the color matching functions X, Y, and Z, (3) a table associating the quantities of backlight with a frequency of occurrence of a crosstalk, or (4) crosstalk coefficients expressed as a matrix may be adopted.

For production of the table (3), frequencies of occurrence of a crosstalk are calculated or experimentally measured by changing the values of the quantities of backlight emitted from the red, green, and blue LEDs included in the backlight, and then listed in the form of a table. The matrix of crosstalk coefficients (4) is produced by utilizing the formula 1.

Correction coefficients required for crosstalk compensation are obtained through inverse calculation of the model. For example, the contents of the table (3) are inversely converted in order to produce a table of correction coefficient values. As for the formula to be used to produce the matrix (4), an inverse matrix is calculated in order to work out a matrix of correction coefficient values. Thus, the coefficients needed to compensate a crosstalk value are associated with the quantities of backlight.

The present invention is characterized in that a change in a color domain caused by a crosstalk is corrected through signal processing. As mentioned above, one of conditions bringing about the crosstalk is that the wavelength regions of light waves emitted from the red, green, and blue LEDs included in the backlight are inconsistent with the passbands of the red, green, and blue color filters at respective sub-pixels. In other words, the wavelength regions and the passbands vary depending on the employed LEDs or the employed color filters. Unless pieces of information on the wavelength regions and passbands are acquired in advance, the magnitude of the crosstalk cannot be determined.

Second Embodiment

The present invention is characterized in that the image display device shown in FIG. 1 includes a characteristic register 20 serving as a memory means in which the pieces of information on the wavelength regions relevant to the quantities of backlight and the wavelength regions relevant to the transmittances at respective sub-pixels are stored for the purpose of signal processing to be performed for crosstalk compensation.

The characteristic register 20 is a memory means in or from which data is written or read. A characteristic signal 21 to be written in the characteristic register 20 carries data concerning, for example, the wavelength regions of light waves emitted from the red, green, and blue LEDs included in the backlight and the passbands of the color filters at respective sub-pixels, data concerning numerical values that are worked out by multiplying the wavelength regions and passbands by the color matching functions, or data concerning the relationship between quantities of backlight emitting from the red, green, and blue LEDs included in the backlight and the crosstalk coefficients.

The timing of writing the characteristic signal 21 in the characteristic register 20 is determined based on the configuration of a display device. For example, assuming that the display device has all display-related circuits incorporated in one housing, the characteristic signal 21 is written in the characteristic register 20 at the time of assembling the components of the display device. In a display device in which a backlight or any other component can be replaced with a new one, the characteristic signal 21 carrying data concerning a new component should be written. The characteristic register 20 should therefore have the capability of a memory that can be rewritten and can preserve written data. Specifically, a flash memory, an EPROM, a SRAM with a battery facility will do. The characteristic signal 21 written in the characteristic register 20 is used to compensate a crosstalk.

An example of a signal processing procedure including crosstalk compensation will be described orderly from step (1) to step (7) below. (1) Image data is received, and the maximum values Rmax, Gmax, and Bmax of red, green, and blue color signals are calculated. (2) The quantities of backlight emitted from the red, green, and blue LEDs included in the backlight are determined. (3) The transmittances at sub-pixels with red, green, and blue color filters respectively are determined. (4) Data representing the relationship between the quantities of backlight emitted from the red, green, and blue LEDs included in the backlight and the crosstalk coefficients is read from the characteristic register. (5) The crosstalk coefficients are calculated based on the quantities of backlight emitted from the red, green, and blue LEDs included in the backlight. (6) The crosstalk coefficients are used to correct the transmittances at sub-pixels with red, green, and blue color filters respectively. (7) The quantities of backlight emitted from the red, green, and blue LEDs included in the backlight, and the corrected transmittances at sub-pixels with red, green, and blue color filters respectively are transmitted.

At step (4), the number of combinations of the quantities of backlight emitted from the red, green, and blue LEDs equals the twenty-fourth power of 2 in a case where each of the red, green, and blue color signals represents eight bits. This means that an amount of data representing the correction coefficients becomes enormous. Any of the methods (1), (2), (3) described below may be adopted in order to reduce the amount of data.

(1) According to a method utilizing a lookup table (LUT), the relationship between the quantities of backlight emitted from the red, green, and blue LEDs, which are an input, and the correction coefficients that are an output is specified in a table. Herein, the input may be discrete data and the output may be calculated through interpolation. This results in a compact table.

(2) According to a method utilizing polynomial approximation, a polynomial expression is used to approximate an arithmetic operation that uses the quantities of backlight emitted from the red, green, and blue LEDs as variables and that provides the correction coefficients. The degree of the polynomial expression is raised in order to improve the precision in approximation. For calculation of the polynomial expression, high-precision multiplication is needed.

(3) According to a method based on emulation, a means is included for emulating the principles of occurrence of a crosstalk through numerical calculation. For example, the aforesaid formula 1 is used as a model to calculate coefficients needed to compensate a crosstalk. The coefficients are used to compensate the crosstalk.

Third Embodiment

Figure 7:
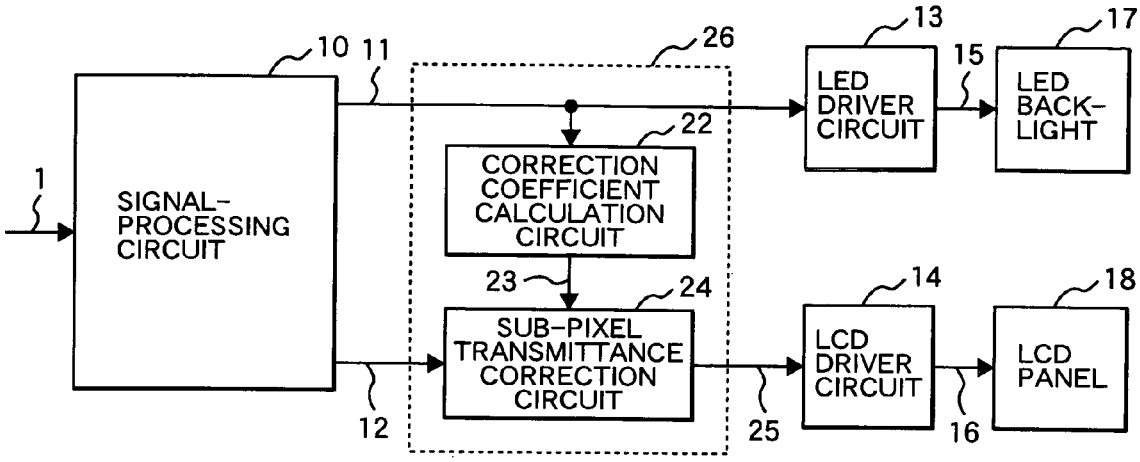
FIG. 7 shows still another configuration of an image display device in accordance with the present invention.

FIG. 7 is a circuit diagram showing circuits needed to execute the signal processing procedure. A crosstalk compensation circuit 26 that is a compensation means for compensating a crosstalk will be described mainly. The other components are identical to those shown in FIG. 1. The quantities 11 of backlight emitted from the red, green, and blue LEDs respectively are calculated based on the maximum values of red, green, and blue signals and then transmitted. A correction coefficient calculation circuit 22 receives the quantities 11 of backlight emitted from the red, green, and blue LEDs respectively, and transmits correction coefficients 23. A sub-pixel transmittance correction circuit 24 corrects the transmittances 12 at respective sub-pixels on the basis of the correction coefficients 23, and transmits the corrected sub-pixel transmittances 25.

Figure 8:
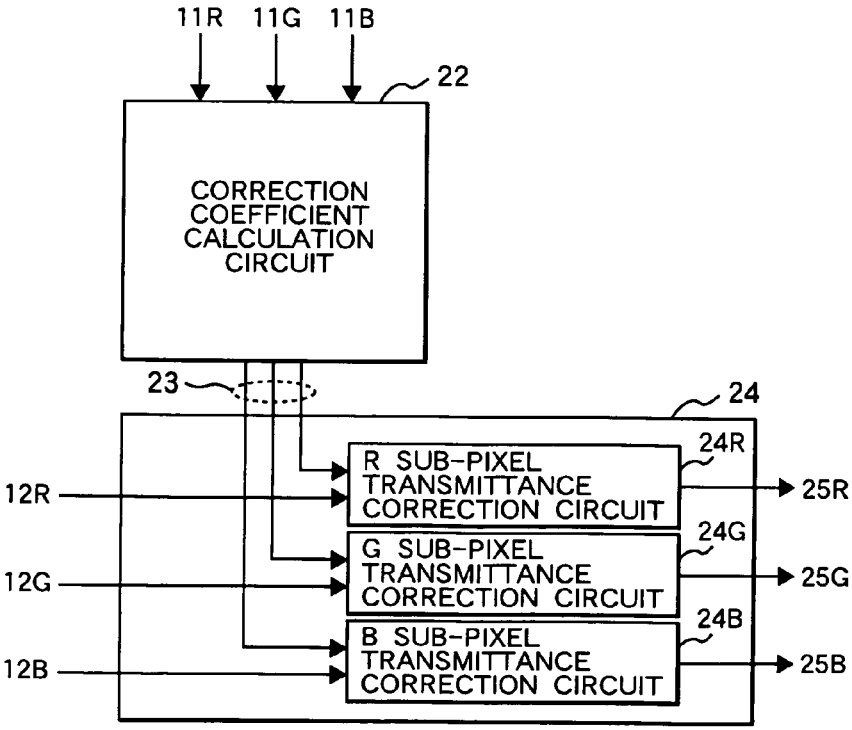
FIG. 8 is a circuit diagram showing a crosstalk compensation circuit employed in an image display device in accordance with the present invention.

FIG. 8 is a circuit diagram showing circuits needed to compensate a crosstalk using a lookup table (LUT). The correction coefficient calculation circuit 22 is realized with a memory, and a lookup table (LUT) needed to compensate a crosstalk is stored in the memory.

Figure 6:
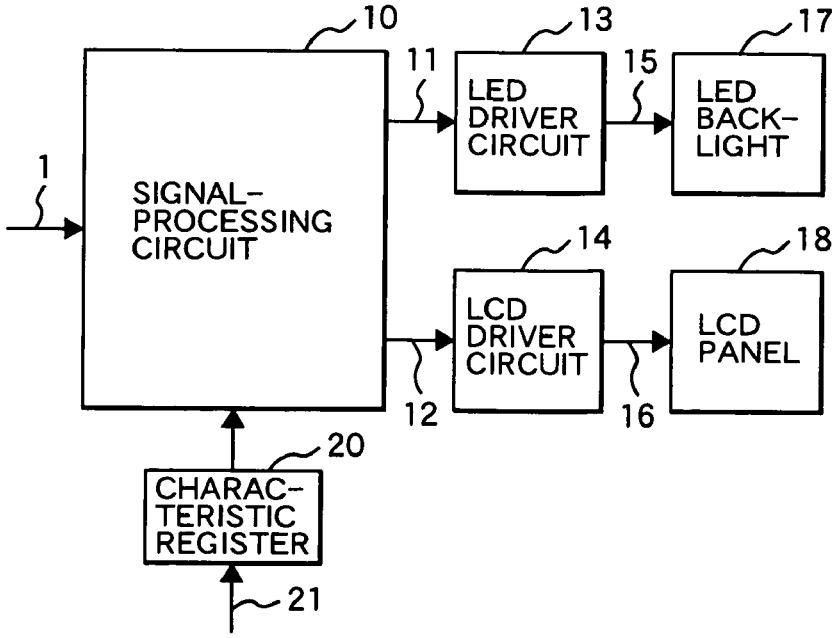
FIG. 6 shows another configuration of an image display device in accordance with the present invention.

The LUT data is calculated from the characteristic signal 21 written in the characteristic register 20 shown in FIG. 6. Otherwise, the characteristic signal 21 may carry the LUT data by itself.

In the LUT shown in FIG. 8, the quantities of backlight emitted from the red, green, and blue LEDs (11R, 11G, 11B) are used as an address with which the memory is accessed. Data read from the memory is transmitted as the correction coefficients 23. The correction coefficients and the transmittances at sub-pixels with red, green, and blue color filters (12R, 12G, 12B) are calculated by red, green, and blue sub-pixel transmittance correction circuits (24R, 24G, 24B) respectively. The corrected transmittances at sub-pixels with red, green, and blue color filters respectively (25R, 25G, 25B) are then transmitted.

As mentioned above, when the LUT is employed, any conversion can be achieved quickly. Furthermore, a gamma other than a crosstalk may also be expressed by the formula for the purpose of comprehensive conversion.

The characteristic resistor 20 may preserve an approximate polynomial expression needed to calculate correction coefficients. In this case, the characteristic signal 21 to be written in the characteristic register 20 carries coefficients to be assigned to the approximate polynomial expression. The polynomial expression may be a combination of a power function and a sine or cosine function. For example, assuming that the coefficients are coefficients A, B, C, and D and a variable is a variable X, an output Y is calculated as $Y=(A+B\cdot X+C\cdot X\cdot X+D\cdot X\cdot X\cdot X)$.

In FIG. 8, when a crosstalk is compensated using polynomial approximation, the correction coefficient calculation circuit 22 includes a polynomial arithmetic circuit that receives as variables the quantities of backlight emitted from red, green, and blue LEDs respectively (11R, 11G, 11B) and transmits correction coefficients. The correction coefficients 23 that are the results of an arithmetic operation are transferred to the sub-pixel transmittance correction circuit 24. The red, green, and blue sub-pixel transmittance correction circuits (24R, 24G, 24B) calculate the transmittances at sub-pixels with red, green, and blue color filters respectively (12R, 12G, 12B) and the correction coefficients 23, and thus transmit the corrected transmittances at sub-pixels with red, green, and blue color filters respectively (25R, 25G, 25B). When the polynomial expression is used to calculate the correction coefficients, the memory required when the LUT method is adopted can be excluded.

Fourth Embodiment

Figure 9:
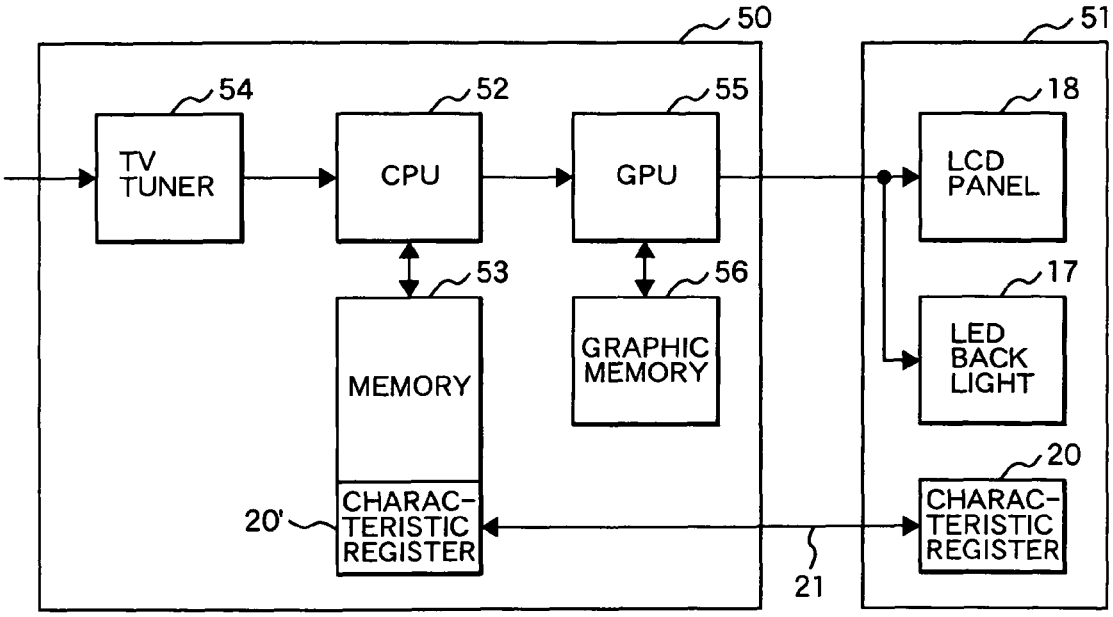
FIG. 9 shows the configuration of a personal-computer television.

FIG. 9 shows the configuration of a so-called personal-computer television having a personal computer 50 and a display panel 51 interconnected over a cable. The main body of the personal computer 50 that is external equipment includes mainly a CPU 52, a memory 53, and a hard disk that is not shown. Moreover, the personal computer 50 includes a TV tuner 54 needed to receive a television image, a GPU 55 needed to display an image, and a graphic memory 56. On the other hand, the display panel 51 includes a backlight 17 and an LCD panel 18.

Assume that the CPU 52 included in the personal computer 50 performs signal processing for independent control of the red, green, and blue LEDs included in the backlight 17 incorporated in the display panel 51. Unless data concerning the wavelength regions of light waves emitted from the red, green, and blue LEDs included in the backlight 17 that is a component of the display panel 51 and data concerning the passbands of the color filters at respective sub-pixels are transferred from the display panel 51 to the personal computer 50, crosstalk compensation and other signal processing concerning wavelengths cannot be performed. Moreover, any type of personal computer should be able to be adopted as the display panel 51 connected to the personal computer 50.

The display panel 51 includes a characteristic register 20 in which the wavelength regions of light waves emitted from the LEDs included in the backlight, which is a component to be incorporated in the panel, and the passbands of the color filters included in the LCD panel are stored. A means is included for transmitting a characteristic signal 21, which carries data concerning the passbands of the color filters included in the display panel 51, from the display panel 51 to the personal computer 50. The personal computer 50 uses part of the memory 53 as a characteristic register 20'.

As mentioned above, the present invention is characterized in that the characteristic registers (20 and 20') in which data concerning wavelengths is stored are included in the display panel 51 and personal computer 50 respectively, and that a data communication means is included for communicate data between the characteristic registers (20 and 20').

Data communication between the characteristic registers (20 and 20') is initiated at the time of changing the display panel 51 from one model to another, at the time of turning on the power supply, or in response to an operator's instruction. For example, a signal cable over whish an image signal is transmitted from the personal computer 50 to the display panel 51 is used to transmit data, which represents the passbands of the color filters incorporated in the display panel 51, from the display panel 51 to the personal computer 50. Otherwise, the personal computer 50 may be connected to the display panel 51 using a general-purpose interface such as a USB-compatible interface, whereby data may be transmitted from the display panel 51 to the personal computer 50.

A signal processing procedure to be followed by the personal computer 50 includes steps (1) to (6) described below. (1) An image signal is received. (2) The quantities of backlight for one screen image and the transmittances of a liquid crystal at respective sub-pixels are calculated. (3) Crosstalk correction coefficients are calculated based on the quantities of backlight. (4) The transmittances of the liquid crystal are corrected. (6) The quantities of backlight and the transmittances of the liquid crystal are transmitted to the display panel 51. (6) A display output is produced. The signal processing is achieved by running a program using the CPU 52 included in the personal computer 50.

For transmission of step (5), a data type different from a data type adopted for a conventional video signal is adopted. For example, assume that the quantities of backlight for each screen image are transmitted during a blanking interval and the transmittances of the liquid crystal at respective pixels are transmitted during an imaging period. In this case, a signal cable can convey the signal of any type irrespective of the electro-physical characteristics thereof. However, as for the contents of the signal, if a conventional display device (for example, a CRT) is used, satisfactory image quality cannot be guaranteed. Assuming that a means for checking a model of equipment is included, when the means identifies a CRT, if a conventional signal transmission method is adopted, a display output can be produced without any problem.

In signal processing to be performed by the personal computer 50, the quantities of backlight for each screen image and the transmittances of a liquid crystal at respective pixels should be treated as pixel signals. Specifically, the pixel signals are read or written as pixels data items from or into the memory 56, and transmitted as pixel data items to the display panel 51.

A description will be made of a data type adopted for the characteristic signal 21 and a signal interface. Fundamentally, the characteristic signal 21 carries data concerning the wavelength regions of light waves emitted from the LEDs included in the backlight and the passbands of the color filters disposed at respective sub-pixels. In this case, however, the amount of data concerning the wavelength regions and passbands is large. Therefore, the data may be multiplied by the color matching functions. The color matching functions are synonymous with spectral tristimulus values X, Y, and Z. In order to carry a signal of such a data type, an intelligence signal is preceded by an identifier with which a data type can be identified so that a receiving side can recognize the data type.

The present invention can be adapted to a liquid crystal display that independently controls the quantities of backlight emitted from red, green, and blue LEDs respectively. Moreover, the present invention can be applied to a television set, a personal computer, or a monitor which utilizes the liquid crystal display.

What is claimed is:

1. An image display device that forms an image, with a display output that is a combination of quantities of backlight of at least three colors and sub-pixel transmittances of at least three colors, the image display device comprising:

a memory means in which the light-emission wavelength distribution characteristics of the quantities of backlight and the transmission wavelength distribution characteristics of the sub-pixel transmittances are stored;

a correction coefficient calculation circuit for calculating crosstalk coefficients required for crosstalk compensation of the light-emission wavelength distribution characteristics of the quantities of the backlight with the transmission wavelength distribution characteristics of the sub-pixel transmittance, thereby compensating for non-conformity between the light-emission wavelength distribution characteristics of the quantities of the backlight in one pixel and the transmittance wavelength distribution characteristics of the sub-pixel transmittances in the one pixel; and a drive means for driving the quantities of backlight independently among the at least three colors;

wherein the light-emission wavelength distribution characteristics of the quantities of backlight and transmission wavelength distribution characteristics of the sub-pixel transmittances are read out from the memory means, and the sub-pixel transmittance of the at least three colors based on the quantities of the backlight of the at least three colors are obtained independently in each one pixel.

2. An image display device that forms an image, with a display output that is a combination of quantities of backlight of at least three colors and sub-pixel transmittances of at least three colors, the image display device comprising:

a drive means for driving the quantities of backlight independently among the at least three colors; and a memory means for storing crosstalk coefficients required for crosstalk compensation of the light-emission wavelength distribution characteristics of the quantities of backlight with the transmission wavelength distribution characteristics of the sub-pixel transmittances, thereby compensating for non-conformity between the light-emission wavelength distribution characteristics of the quantities of the backlight in one pixel and the transmittance wavelength distribution characteristics of the sub-pixel transmittances in the one pixel;

wherein the crosstalk coefficients are read from the memory means, and the sub-pixel transmittances of the at least three colors based on the quantities of backlight of the at least three colors are obtained independently in each one pixel.

3. An image display device according to claim 1, which further comprises:

a compensation means for compensating the crosstalk of the light-emission wavelength distribution characteristics of the quantities of backlight with the transmission wavelength distribution characteristics of the sub-pixel transmittances, wherein the compensation means corrects the sub-pixel transmittances on the basis of the quantities of backlight.

4. An image display device according to claim 1, which further comprises:

a means for calculating correction coefficients on the basis of the quantities of backlight; and a means for correcting the sub-pixel transmittances using the correction coefficients.

5. An image display device according to claim 1, which further comprises:

a drive means for driving the quantities of backlight independently among the at least three colors;

a drive means for controlling the sub-pixel transmittances;

a means for calculating correction coefficients on the basis of the quantities of backlight; and a means for correcting the sub-pixel transmittances using the correction coefficients.

6. An image display device according to claim 1, which further comprises:

a memory means in which the light-emission wavelength distribution characteristics of the quantities of backlight and the transmission wavelength distribution characteristics of the sub-pixel transmittances are stored;

a data communication means for transmitting the light-emission wavelength distribution characteristics of the quantities of backlight, and transmission wavelength distribution characteristics of the sub-pixel transmittances, between the memory means and an external memory means.

7. An image display device according to claim 1, wherein the quantities of backlight and the sub-pixel transmittances are stored in an external image memory means and processed.

8. An image display device comprising:

a liquid crystal panel;

a backlight;

a light emitting diode (LED) drive circuit that independently controls the quantities of each of at least red, green, and blue (RGB) colors generated by a backlight;

a liquid crystal display (LCD) drive circuit that independently controls the transmittance of each of at least one red sub-pixel, at least one green sub-pixel, and at least one blue sub-pixel of the liquid crystal panel;

a memory that stores RGB wavelength distribution characteristics of the backlight, and RGB wavelength distribution characteristics of the transmittance of the sub-pixels of the liquid crystal panel; and a correction coefficient calculation circuit that corrects the transmittance of at least one sub-pixel of the liquid crystal panel using the RGB wavelength distribution characteristics of the backlight stored in the memory, and the RGB wavelength distribution characteristics of the transmittance of the sub-pixels of the liquid crystal panel stored in the memory, thereby compensating for non-conformity between the RGB wavelength distribution characteristics of the quantities of the backlight of the at least one sub-pixel of the liquid crystal panel and the RGB wavelength distribution characteristics of transmittance of the sub-pixels of the liquid crystal panel; and wherein the sub-pixel transmittances of the at least red, green, and blue (RGB) colors based on the quantities of backlight of the at least red, green, and blue (RGB) colors are obtained independently in each one pixel.

9. The image display device according to claim 8, wherein the RGB wavelength distribution characteristics of the backlight and the RGB wavelength distribution characteristics of the transmittance of the sub-pixels of the liquid crystal panel are inconsistent with each other.

10. The image display device according to claim 8, which further comprises a data communication means that transmits the RGB wavelength distribution characteristics of the backlight and the RGB wavelength distribution characteristics of the transmittance of the sub-pixels of the liquid crystal panel between the memory means and an external memory means.

11. The image display device according to claim 1, wherein the crosstalk compensation is conducted by stabilizing color reproduction by suppressing the variation of the chromaticity values in the color domain wherein the backlight emits monochrome light with the color domain, wherein the backlight emits full color.

12. The image display device according to claim 2, wherein the crosstalk compensation is conducted by stabilizing color reproduction by suppressing the variation of the chromaticity values in the color domain wherein the backlight emits monochrome light with the color domain, wherein the backlight emits full color.

13. The image display device according to claim 8, wherein the crosstalk compensation is conducted by stabilizing color reproduction by suppressing the variation of the chromaticity values in the color domain wherein the backlight emits monochrome light with the color domain, wherein the backlight emits full color.

* * * * *